US009422655B2

(12) United States Patent
Tashiro et al.

(10) Patent No.: US 9,422,655 B2
(45) Date of Patent: Aug. 23, 2016

(54) CONTAINER AND SEWING MACHINE PROVIDED WITH THE CONTAINER

(71) Applicant: BROTHER KOGYO KABUSHIKI KAISHA, Nagoya-shi, Aichi-ken (JP)

(72) Inventors: Noriharu Tashiro, Nagoya (JP); Midori Komada, Matsusaka (JP); Harumi Kobayashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/717,514

(22) Filed: May 20, 2015

(65) Prior Publication Data

US 2015/0345058 A1 Dec. 3, 2015

(30) Foreign Application Priority Data

May 27, 2014 (JP) ..... 2014-108999

(51) Int. Cl.

*D05B 81/00* (2006.01)
*D05B 73/04* (2006.01)
*D05B 37/06* (2006.01)

(52) U.S. Cl.

CPC ..... *D05B 81/00* (2013.01); *D05B 37/06* (2013.01); *D05B 73/04* (2013.01); *D05D 2305/50* (2013.01)

(58) Field of Classification Search

CPC ..... D05B 81/00; D05B 73/00; D05B 73/04; D05B 73/06; D05B 73/08; D05B 65/06; D05B 37/06; D05D 2305/50

See application file for complete search history.

(56) References Cited

U.S. PATENT DOCUMENTS 3,084,647 A * 4/1963 Edwards ..... D05B 57/26 112/181
3,182,620 A * 5/1965 Hornberger, Sr. ..... D05B 65/06 112/287
3,403,648 A * 10/1968 Jarrett ..... D05B 15/00 112/130
3,853,079 A * 12/1974 Dunne ..... D05B 37/00 112/282
3,948,194 A * 4/1976 Gunold ..... D05B 37/00 112/130
4,375,712 A * 3/1983 Kato ..... D05B 81/00 16/282
4,709,645 A * 12/1987 Jones ..... D05B 37/00 112/282
5,454,338 A * 10/1995 McEwen ..... D05B 71/00 112/256
6,131,527 A * 10/2000 Park ..... A47L 7/0047 108/102
2009/0107374 A1 4/2009 Ukai et al.
2010/0287968 A1 11/2010 Sakashita et al.

FOREIGN PATENT DOCUMENTS

JP 2004-222896 A 8/2004
JP 2009-100991 A 5/2009
JP 2009-198165 A 9/2009
JP 2009-198166 A 9/2009

* cited by examiner

*Primary Examiner* — Ismael Izaguirre
(74) *Attorney, Agent, or Firm* — Oliff PLC

(57) ABSTRACT

A container includes a cover body and a holding body, and is removably mounted on a needle plate of a sewing machine including a horizontal shuttle. The horizontal shuttle includes an inner shuttle that includes a bobbin containing portion. The cover body is plate-shaped, is removably mounted in the needle plate in a position above the horizontal shuttle, and includes a through-hole and a first face that occupies the same plane as a top face of the needle plate when the cover body is mounted in the needle plate. The holding body is disposed inside the bobbin containing portion and includes a side wall and a bottom wall. The side wall encircles an area of a second face in which the through-hole is formed. The second face is a face on the opposite side of the cover body from the first face. The bottom wall is opposite the second face.

17 Claims, 13 Drawing Sheets

CONTAINER AND SEWING MACHINE PROVIDED WITH THE CONTAINER

CROSS-REFERENCE TO RELATED APPLICATION

This application claims priority to Japanese Patent Application No. 2014-108999 filed May 27, 2014, the content of which is hereby incorporated herein by reference.

BACKGROUND

The present disclosure relates to a container that is able to contain waste fiber that is generated by cutting of a work cloth, and to a sewing machine that is provided with the container.

A sewing machine that is capable of performing needle punching is known. As an example of a sewing machine that is capable of performing needle punching, a sewing machine is known that is provided with a waste box that contains waste fiber that is generated in the needle punching process, the waste box being provided underneath a needle plate that is mounted on a bed of the sewing machine.

SUMMARY

However, the sewing machine is provided with a shuttle mechanism underneath the needle plate. Therefore, in the sewing machine that is described above, it is necessary to ensure a space inside the bed for placing the waste box in a position where it does not interfere with the shuttle mechanism.

Embodiments of the broad principles derived herein provide a container that is able to contain the waste fiber and that is disposed inside a bobbin containing portion of a horizontal shuttle such that a dedicated space for the container inside the bed is not required, and also provide a sewing machine that is provided with the container.

A container according to a first embodiment of the present disclosure includes a cover body and a holding body. The container is configured to be removably mounted on a needle plate of a sewing machine that is provided with a horizontal shuttle inside a bed in which the needle plate is provided. The horizontal shuttle is provided with an outer shuttle and an inner shuttle. The inner shuttle is disposed inside the outer shuttle and includes a bobbin containing portion that accommodates a bobbin. The cover body is plate-shaped and is configured to be removably mounted in the needle plate in a position above the horizontal shuttle. The cover body includes a first face and a through-hole that extends through the cover body. The first face is configured to occupy the same plane as a top face of the needle plate when the cover body is mounted in the needle plate. The holding body is configured to be disposed inside the bobbin containing portion and includes a side wall and a bottom wall. The side wall encircles an area of a second face in which the through-hole is formed. The second face is a face on the opposite side of the cover body from the first face. The bottom wall is disposed such that the bottom wall is opposite the second face.

Further, a sewing machine according to a second embodiment of the present disclosure includes a horizontal shuttle, a needle plate, and a container. The horizontal shuttle is provided with an outer shuttle and an inner shuttle, and is in a bed. The inner shuttle is disposed inside the outer shuttle and includes a bobbin containing portion. The bobbin containing portion accommodates a bobbin. The needle plate is provided in a top portion of the bed. The container is configured to be removably mounted on the needle plate and is provided with a cover body and a holding body. The cover body is plate-shaped and is configured to be removably mounted in the needle plate in a position above the horizontal shuttle. The cover body includes a first face and a through-hole that extends through the cover body. The first face is configured to occupies the same plane as a top face of the needle plate when the cover body is mounted in the needle plate. The holding body is configured to be disposed inside the bobbin containing portion and including a side wall and a bottom wall. The side wall encircles an area of a second face in which the through-hole is formed. The second face is a face on the opposite side of the cover body from the first face. The bottom wall being disposed such that the bottom wall is opposite the second face.

BRIEF DESCRIPTION OF THE DRAWINGS

Embodiments will be described below in detail with reference to the accompanying drawings in which.

DETAILED DESCRIPTION

Figure 1:
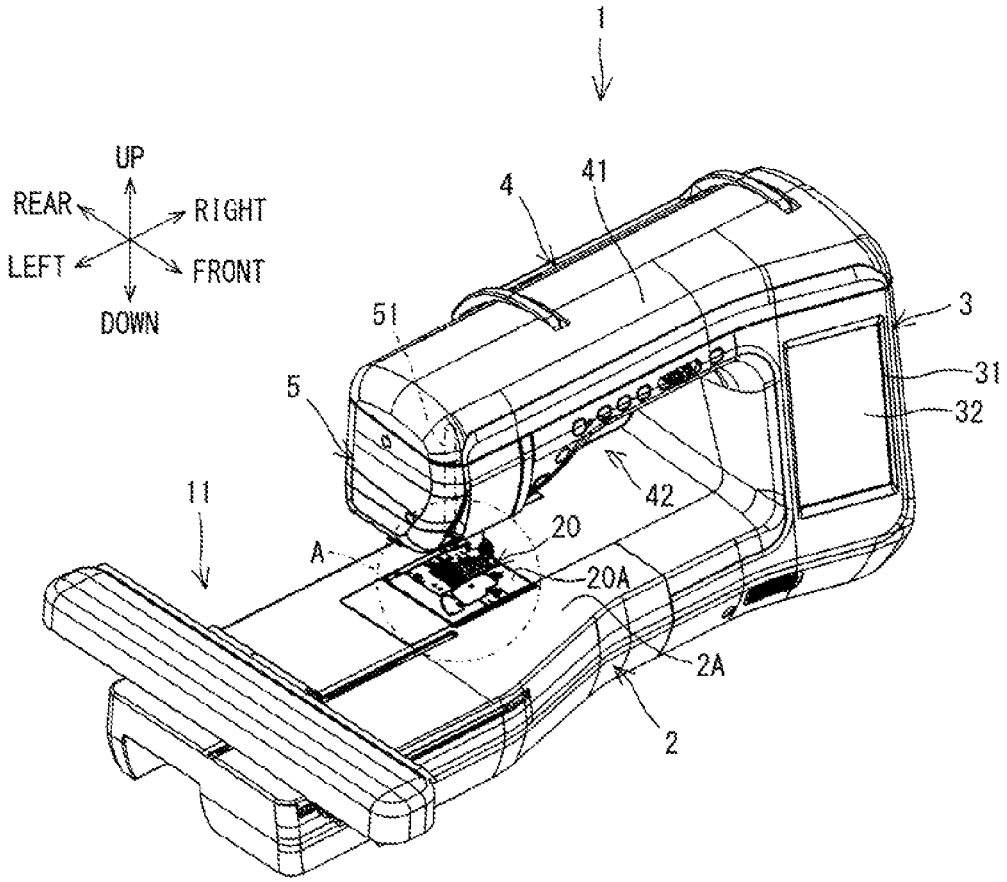
FIG. 1 is an oblique view of a sewing machine 1.

Hereinafter, an embodiment that gives material form to the present disclosure will be explained with reference to the drawings. Note that the drawings are used for explaining technological features that the present disclosure can utilize. Accordingly, device configurations and the like that are shown in the drawings are merely explanatory examples and do not serve to restrict the present disclosure to those configurations, flowcharts, and the like, unless otherwise indicated specifically. First, the physical configuration of a sewing machine 1 will be explained with reference to FIGS. 1 to 3. In the explanation that follows, the top side, the bottom side, the lower right side, the upper left side, the lower left side, and the upper right side in FIG. 1 respectively define the top side, the bottom side, the front side, the rear side, the left side, and the right side of the sewing machine 1. In other words, the side on which a liquid crystal display (hereinafter called the LCD) 31 that will be described later is disposed is the front side of the sewing machine 1. The direction in which the longer dimensions of a bed 2 and an arm 4 are oriented is a left-right direction of the sewing machine 1. The side of the bed 2 on which a pillar 3 is disposed is the right side. The direction in which the pillar 3 extends is an up-down direction of the sewing machine 1.

As shown in FIG. 1, the sewing machine 1 is mainly provided with the bed 2, the pillar 3, and the arm 4. The bed 2 is the base portion of the sewing machine 1 and extends in left-right direction. The pillar 3 extends upward from the right end of the bed 2. The arm 4 extends to the left from the upper end of the pillar 3 such that it is opposite the bed 2. The left end of the arm 4 is a head 5.

Figure 2:
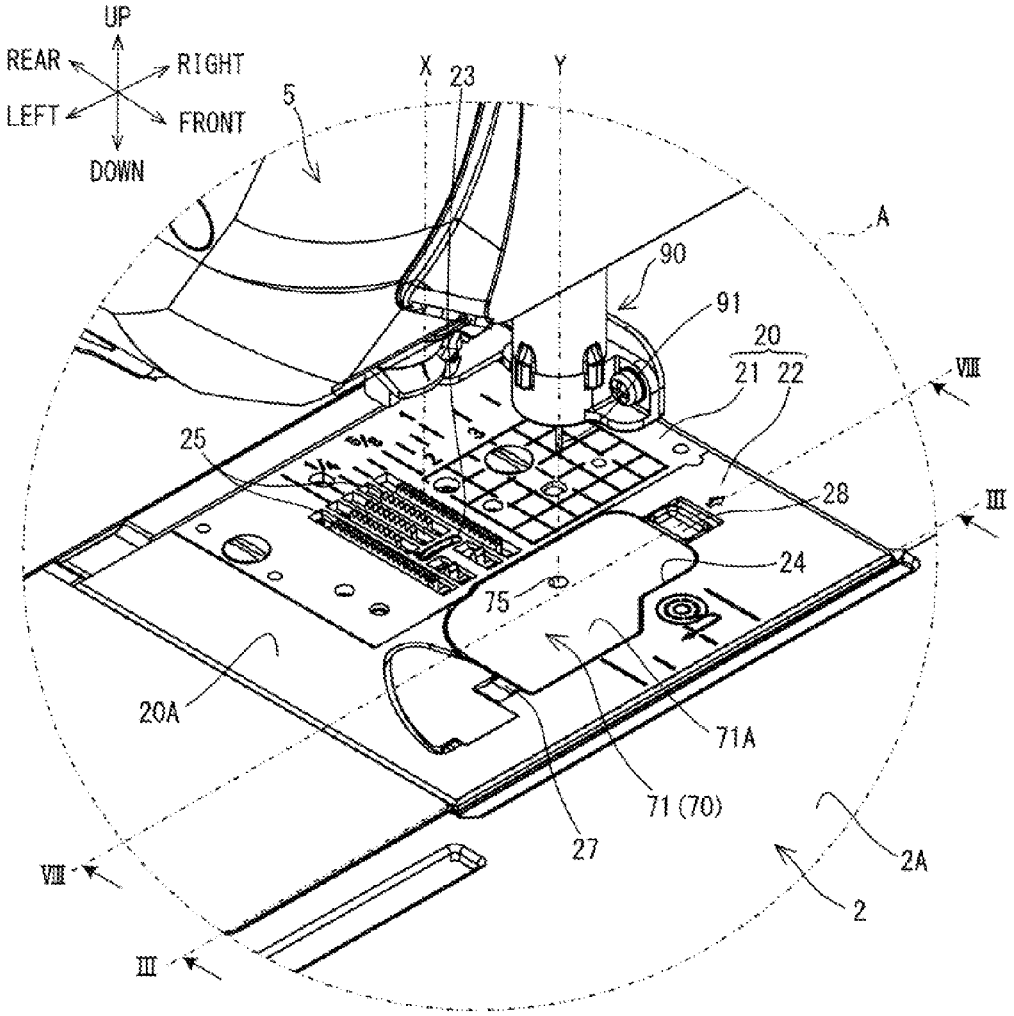
FIG. 2 is an oblique view of the sewing machine 1, in which an area that is indicated by a two-dot chain line A in FIG. 1 is enlarged.

A substantially rectangular needle plate 20 is provided on a top face 2A of the bed 2. A top face 20A of the needle plate 20 forms a flat surface that is substantially in the same plane as the top face 2A of the bed 2. A work cloth (not shown in the drawings) is placed on the top face 2A of the bed 2 and the top face 20A of the needle plate 20. As shown in FIG. 2, the needle plate 20 of the present embodiment includes a first needle plate 21 and a second needle plate 22. The first needle plate 21 is substantially rectangular in a plan view. The second needle plate 22 is substantially L-shaped in a plan view. The first needle plate 21 is provided below a needle bar 51 (refer to FIG. 1) that is provided in the head 5. The first needle plate 21 has a needle hole 23 that extends vertically through the first needle plate 21. The needle hole 23 is an oblong hole that extends from left to right. When sewing is performed, the tip of a sewing needle (not shown in the drawings) that is mounted on the lower end of the needle bar 51 is passed through the needle hole 23 as the needle bar 51 moves up and down. The second needle plate 22 is provided on a top portion of a bobbin containing portion 84 (refer to FIG. 3) of a shuttle mechanism 80 that will be described later. The second needle plate 22 has an opening 24 that extends vertically through the second needle plate 22. A bobbin (not shown in the drawings) around which a lower thread is wound can be mounted in the bobbin containing portion 84. When the bobbin is mounted in the bobbin containing portion 84, a needle plate cover (not shown in the drawings) can be attached to the opening 24. The needle plate cover closes off the top portion of the bobbin containing portion 84. Furthermore, when the bobbin is not mounted in the bobbin containing portion 84, a cover portion 71 (described later) can be attached to the opening 24. The cover portion 71 is provided with a waste container 70 that can be disposed inside the bobbin containing portion 84.

The second needle plate 22 is provided with a support plate 27 and an opening-and-closing lever 28 at the left edge and the right edge, respectively, of the opening 24. In a case where one of the needle plate cover and the cover portion 71 has been attached to the opening 24, the support plate 27 presses from above on a projecting portion 77 (refer to FIG. 6) that is provided on the left edge of the one of the needle plate cover and the cover portion 71. The opening-and-closing lever 28 engages with a hook 76 (refer to FIG. 6) that is provided on the right edge of the one of the needle plate cover and the cover portion 71. The opening-and-closing lever 28 is energized toward the left against the second needle plate 22. When the opening-and-closing lever 28 is not being operated, the opening-and-closing lever 28 maintains the state of engagement with the hook 76. The opening-and-closing lever 28 and the support plate 27 maintain a state in which the one of the needle plate cover and the cover portion 71 closes off the opening 24. If the opening-and-closing lever 28 is slid to the right, the state of engagement between the opening-and-closing lever 28 and the hook 76 is released. When the state of engagement is released, the support plate 27 presses the projecting portion 77 downward, so the right edge of the one of the needle plate cover and the cover portion 71 moves upward, with the side where the projecting portion 77 is located serving as a fulcrum point. The separating of the one of the needle plate cover and the cover portion 71 from the second needle plate 22, as just described, opens up the opening 24.

A lower shaft (not shown in the drawings) is provided inside the bed 2. The lower shaft is rotationally driven by a main shaft (not shown in the drawings) that will be described later. A feed mechanism (not shown in the drawings), a feed dog 25 (only the upper edges of which are shown in FIG. 2), the shuttle mechanism 80 (refer to FIG. 3), a lower thread sensor 95 (refer to FIG. 3), and the like are provided inside the bed 2, underneath the needle plate 20. The feed mechanism drives the feed dog 25. When ordinary sewing is performed in a state in which an embroidery frame moving device 11 that will be described later is not mounted on the sewing machine 1, the feed dog 25 moves the work cloth.

Figure 3:
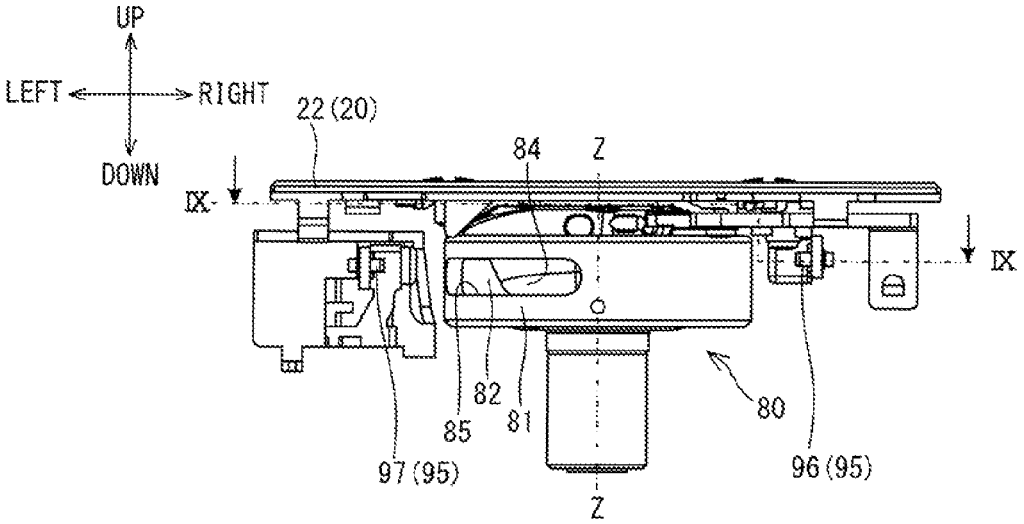
FIG. 3 is a front view of a shuttle mechanism 80 and a needle plate 20, as seen from the direction of arrows on a two-dot chain line in FIG. 2.

The shuttle mechanism 80 is a mechanism of a known configuration that forms a stitch in the work cloth by operating in coordination with the sewing needle (not shown in the drawings) that is mounted on the lower end of the needle bar 51, which will be described later. As shown in FIG. 3, the shuttle mechanism 80 is provided with an outer shuttle 81, an inner shuttle 82, and a locking member (not shown in the drawings). The outer shuttle 81 is rotated horizontally by the rotation of the lower shaft. The inner shuttle 82 is disposed to the inside of the outer shuttle 81. The locking member locks the inner shuttle 82 such that it cannot rotate. That is, the inner shuttle 82 is locked by the locking member such that it cannot rotate, even if the outer shuttle 81 rotates.

The bobbin containing portion 84 in which the bobbin (not shown in the drawings) is contained is formed in the inner shuttle 82. The bobbin containing portion 84 is located underneath the opening 24 of the second needle plate 22 (refer to FIG. 2). Two openings are formed in the bobbin containing portion 84 of the inner shuttle 82, although this is not shown in detail in the drawings. The two openings are provided on a light path L (refer to FIGS. 8, 9) that extends between a light-emitting portion 96 and a light-receiving portion 97 of the lower thread sensor 95, which will be described later. In other words, light that is emitted from the light-emitting portion 96 is able to pass through one of the two openings, the bobbin containing portion 84 and the other of the two openings.

An oblong hole 85 and a notch (not shown in the drawings) are formed in the outer shuttle 81. The oblong hole 85 and the notch are provided on the light path L, in positions that are on opposite sides of a rotational axis Z. (refer to FIGS. 3, 8). In other words, when the oblong hole 85 and the notch are positioned on the light path L, the light that the light-emitting portion 96 emits is able to pass through the outer shuttle 81, even when the outer shuttle 81 is rotating.

The lower thread sensor 95 detects the amount of the lower thread that is wound around the bobbin that is mounted in the bobbin containing portion 84. The lower thread sensor 95 is provided with the light-emitting portion 96 and the light-receiving portion 97. The light-emitting portion 96 emits light toward the light-receiving portion 97. The light-receiving portion 97 generates an electric current that corresponds to the intensity of the light it has received, passes the current through a current-to-voltage conversion circuit (not shown in the drawings), and outputs the resulting voltage to a CPU 61 of a control portion 60 (refer to FIG. 10). The light-emitting portion 96 and the light-receiving portion 97 are respectively provided to the right and the left of the shuttle mechanism 80. The light that is emitted from the light-emitting portion 96 travels along the light path L, passing through one of the oblong hole 85 and the notch in the outer shuttle 81, one of the two openings in the inner shuttle 82, the bobbin containing portion 84, the other of the two openings in the inner shuttle 82, and the other of the oblong hole 85 and the notch, and is received by the light-receiving portion 97. When sewing is performed, the bobbin around which the lower thread is wound is mounted in the bobbin containing portion 84, the lower thread is consumed as the sewing operation progresses, and the amount of the lower thread gradually diminishes. When the amount of the lower thread that is wound around the bobbin is large, the light that the light-emitting portion 96 emits is obstructed by the lower thread that is wound around the bobbin. However, as the amount of the lower thread that is wound around the bobbin decreases, the light that the light-emitting portion 96 emits passes through without being obstructed by the lower thread that is wound around the bobbin and is received by the light-receiving portion 97. Based on the intensity of the light that has been received by the light-receiving portion 97, the CPU 61 of the sewing machine 1 (refer to FIG. 10) detects that the amount of the lower thread has reached a specified amount.

As shown in FIG. 1, the LCD 31 is provided on the front face of the pillar 3. Information that includes various types of items, such as commands, illustrations, setting values, messages, and the like, is displayed on the LCD 31. A touch panel 32 is provided on the front face of the LCD 31. The touch panel 32 accepts the input of an operation that is performed using a finger, a special touch pen, or the like. A sewing machine motor 33 (refer to FIG. 10), the control portion 60 (refer to FIG. 10), and the like are provided inside the pillar 3. The sewing machine motor 33 rotationally drives the main shaft (not shown in the drawings), which is provided inside the arm 4. The main shaft and the lower shaft are coupled by a timing belt (not shown in the drawings), and the rotation of the main shaft is transmitted to the lower shaft, such that rotations of the main shaft and the lower shaft are synchronized. A main shaft angle detector 34 that detects the rotational angle of the main shaft is provided in the sewing machine 1, although it is not shown in detail in the drawings.

A cover 41 that can be opened and closed is provided in the upper portion of the arm 4. In FIG. 1, the cover 41 is in the closed state. A spool (not shown in the drawings) is accommodated under the cover 41. During sewing, an upper thread (not shown in the drawings) that is wound around the spool is supplied from the spool to the sewing needle (not shown in the drawings) that is mounted on the needle bar 51, by way of a specified path that is provided in the head 5. Note that in the sewing machine 1 of the present embodiment, a cutting needle unit 90 that will be described later is mounted instead of the sewing needle being mounted on the needle bar 51. A plurality of operation switches 42 that include a sewing start-and-stop switch are provided in the lower portion of the front face of the arm 4.

The needle bar 51 extends downward from the lower end of the head 5. One of the sewing needle (not shown in the drawings) and the cutting needle unit 90 can be mounted on the lower end of the needle bar 51. A needle bar up-and-down moving mechanism (not shown in the drawings) is provided inside the head 5. The needle bar up-and-down moving mechanism is a mechanism that moves the needle bar 51 up and down in conjunction with the rotation of the main shaft.

In the sewing machine 1, in a case where embroidery sewing is performed or cut work is performed by the cutting needle unit 90, the embroidery frame moving device 11 is mounted on the left end of the bed 2. An embroidery frame (not shown in the drawings) that holds the work cloth can be mounted on the embroidery frame moving device 11. The embroidery frame moving device 11 is provided with a drive mechanism (not shown in the drawings) in its interior, and it moves the embroidery frame toward the front and the rear, and to the left and the right, on the bed 2. The sewing machine 1 is able to sew an embroidery pattern in the work cloth that is held in the embroidery frame, and it can also use a cutting needle 91 that is mounted in the cutting needle unit 90 to cut a specified shape in the work cloth.

Figure 4:
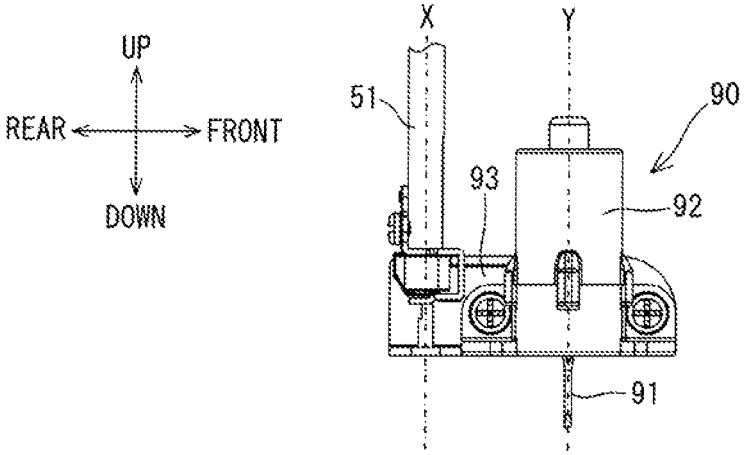
FIG. 4 is a left side view of a cutting needle unit 90 that is mounted on a needle bar 51.

Next, the cutting needle unit 90 will be explained with reference to FIGS. 2 and 4. The cutting needle unit 90 is provided with the cutting needle 91, which cuts the work cloth. The cutting needle 91 has a vertically extending rod shape, on the tip (the lower end) of which is formed a cutting tip of a specified width. As shown in FIG. 4, the cutting needle unit 90 is provided with a body 92 and a mounting portion 93. In a state in which the tip of the cutting needle 91 protrudes downward from the lower end of the body 92, the body 92 supports the base end of the cutting needle 91.

The cutting needle unit 90 is affixed to the needle bar 51, on which the sewing needle is not mounted, by affixing the mounting portion 93 to the needle bar 51. As shown in FIG. 2, in the state in which the cutting needle unit 90 is affixed to the needle bar 51, the position of a center axis Y of the cutting needle 91 is offset by a specified distance toward the front from the position of a center axis X of the needle bar 51. In the present embodiment, the center axis X of the needle bar 51 (the sewing needle) is positioned inside the needle hole 23 in the needle plate 20. In contrast to this, the center axis Y of the cutting needle 91 is positioned inside the bobbin containing portion 84 of the inner shuttle 82. When cut work is being performed, the cover portion 71 of the waste container 70, which will be described later, is attached to the opening 24 of the second needle plate 22 and closes off the top of the bobbin containing portion 84. A through-hole 75 that extends vertically through the cover portion 71 is formed in a position that corresponds to the position of the center axis Y of the cutting needle 91. When cut work is performed, the tip of the cutting needle 91 can be inserted through the through-hole 75. That is, the center axis Y of the cutting needle 91 is the position where the cutting needle 91 passes through the through-hole 75.

Figure 5:
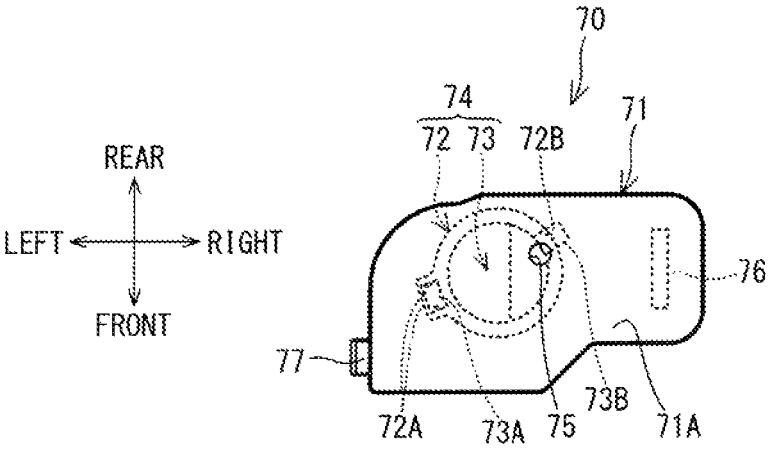
FIG. 5 is a plan view of a waste container 70.
Figure 6:
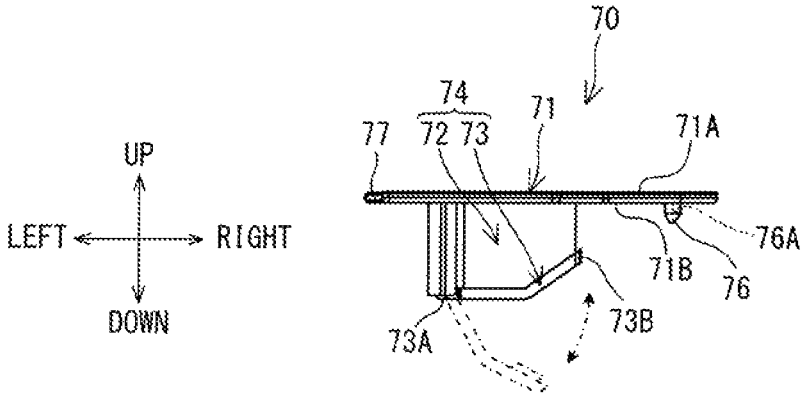
FIG. 6 is a front view of the waste container 70.
Figure 7:
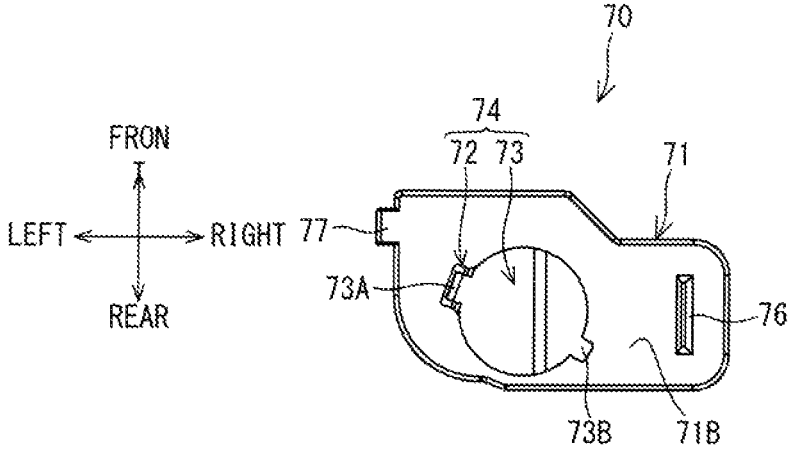
FIG. 7 is a bottom view of the waste container 70.

Next, the waste container 70 will be explained with reference to FIGS. 5 to 9. In a case where cut work is performed, the waste container 70 contains waste fiber (not shown in the drawings) that is generated when the cutting needle 91 cuts the work cloth. As shown in FIGS. 5 to 7, the waste container 70 is provided with the cover portion 71 and a holding portion 74. The cover portion 71 is formed in a plate shape, and it closes off the opening 24 when the waste container 70 is mounted on the needle plate 20. The cover portion 71 has a shape that matches the shape of the opening 24 in the second needle plate 22, its left-right dimension being the longest, and with its right front corner portion missing. The cover portion 71 is provided with the hook 76 near the right edge of an underside 71B. When the cover portion 71 has closed off the opening 24, the underside 71B forms the bottom face of the cover portion 71. The hook 76 projects downward from the underside 71B, extending in the front-rear direction, and the corners of its lower edge are chamfered. A recessed portion 76A that makes the right side face of the hook 76 open is formed in the hook 76. When the cover portion 71 has closed off the opening 24, the recessed portion 76A engages with the opening-and-closing lever 28 (refer to FIG. 8). The projecting portion 77, which projects toward the left, is provided toward the front of the left edge of the cover portion 71. In a case where the cover portion 71 has been attached to the opening 24, as described above, the projecting portion 77 is pressed from above by the support plate 27 of the second needle plate 22, such that the state in which the opening 24 is closed off by the cover portion 71 is maintained. The through-hole 75, which extends vertically through the cover portion 71, is formed approximately in the center of the left-right direction of the cover portion 71 and to the rear of the center in the front-rear direction. As described above, when the cover portion 71 is mounted on the opening 24, the position of the through-hole 75 is a position that corresponds to the inside of the bobbin containing portion 84.

The holding portion 74 is provided such that it projects downward from the underside 71B of the cover portion 71. The holding portion 74 is formed in a circular container shape from a resinous material through which light can pass. The holding portion 74 has a shape that fits inside the bobbin containing portion 84 when the cover portion 71 is attached to the opening 24. The right side portion of the bottom side of the holding portion 74 is inclined upward. It is therefore possible to avoid interference between the holding portion 74 and the inner side of the bobbin containing portion 84 when the cover portion 71 closes off and opens up the opening 24 of the second needle plate 22. The holding portion 74 is provided with a circumferential wall portion 72 and a bottom wall portion 73. The circumferential wall portion 72 and the bottom wall portion 73 are transparent, such that light can pass through them. The circumferential wall portion 72 is formed as a single piece with the cover portion 71, and it projects downward in a ring shape, enclosing the through-hole 75 in the underside 71B. The right side portion of the bottom side of the circumferential wall portion 72 is inclined upward, and a notch 72B is formed such that it is recessed into the right edge of the circumferential wall portion 72. On the left side of its bottom edge, the circumferential wall portion 72 is provided with two protruding parts 72A that protrude toward the front and the rear, with a specified interval between them.

The bottom wall portion 73 is configured in a circular plate shape of substantially the same size as the outside diameter of the circumferential wall portion 72. A portion on the right side of the bottom wall portion 73 is bent upward. A protruding portion 73B that protrudes upward and to the right is formed on the right edge of the bottom wall portion 73. The protruding portion 73B engages with the notch 72B of the circumferential wall portion 72. A support portion 73A, which projects to the left and on which recessed portions (not shown in the drawings) are formed in the front and rear end faces, is formed on the left edge of the bottom wall portion 73. The recessed portions of the support portion 73A engage with the protruding parts 72A of the circumferential wall portion 72, such that the bottom wall portion 73 pivots, with the circumferential wall portion 72 serving as the fulcrum point. That is, the side of the bottom wall portion 73 where the protruding portion 73B is located is able to swing up and down, with the support portion 73A serving as the fulcrum point. When the bottom wall portion 73 has been swung upward and the protruding portion 73B is engaged with the notch 72B, the bottom wall portion 73 closes off the opening at the lower edge of the circumferential wall portion 72. As described above, the waste container 70 is formed as a hollow container that is connected to the outside through the through-hole 75.

Figure 8:
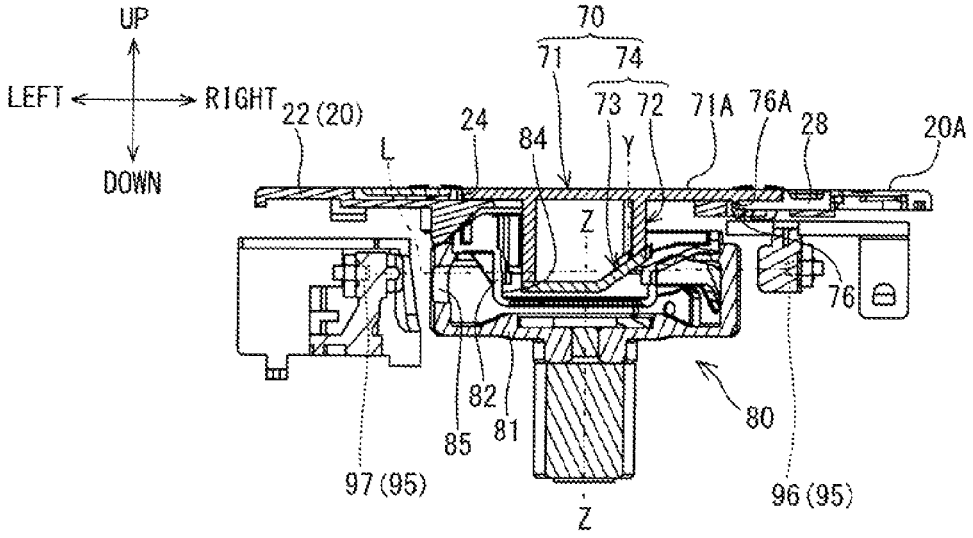
FIG. 8 is a section view of the shuttle mechanism 80, on which the waste container 70 is mounted, the needle plate 20, and a lower thread sensor 95, as seen from the direction of arrows on a two-dot chain line VIII-VIII in FIG. 2.
Figure 9:
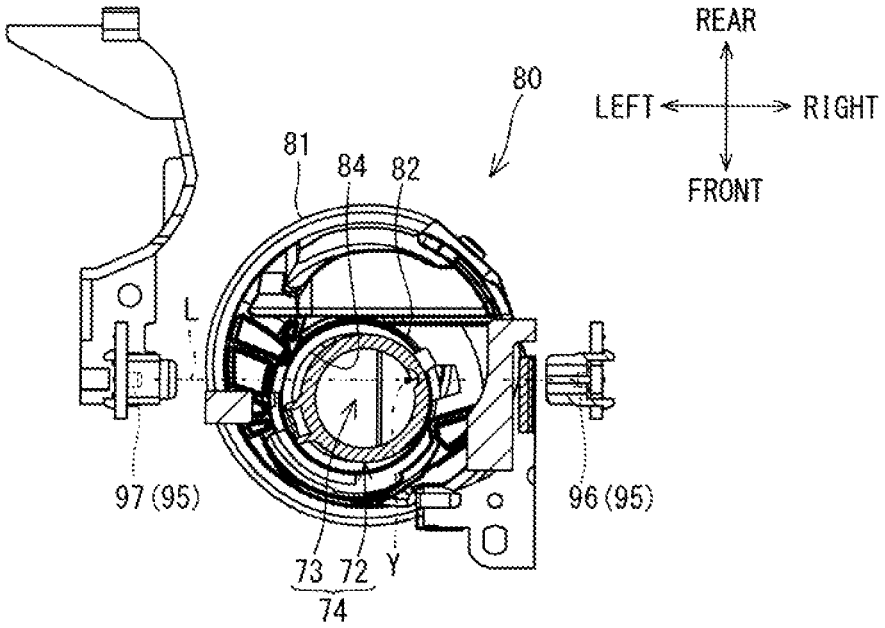
FIG. 9 is a section view of the shuttle mechanism 80, on which the waste container 70 is mounted, the needle plate 20, and the lower thread sensor 95, as seen from the direction of arrows on a two-dot chain line IX-IX in FIG. 3.

As shown in FIG. 2, the waste container 70 can be mounted in and removed from a position in the upper portion of the bed 2 that is above the shuttle mechanism 80 that is provided inside the bed 2. As shown in FIGS. 8 and 9, in the present embodiment, the waste container 70 is mounted in the second needle plate 22 of the needle plate 20 by attaching the cover portion 71 to the opening 24 in a position above the shuttle mechanism 80. The pressing on the projecting portion 77 from above by the support plate 27 of the second needle plate 22 (refer to FIG. 2) and the engaging of the opening-and-closing lever 28 with the recessed portion 76A of the hook 76 that is provided on the underside 71B enable the cover portion 71 to maintain the closed-off state of the opening 24. An outer side 71A, which is the top face of the cover portion 71 when the opening 24 is closed off, forms a flat surface that is substantially in the same plane as the top face 20A of the needle plate 20. That is, the outer side 71A forms a flat surface that is substantially in the same plane as the top face 2A of the bed 2.

As explained above, the holding portion 74 is formed into a shape that fits inside the bobbin containing portion 84. The holding portion 74, which is provided on the underside 71B of the cover portion 71, is disposed inside the bobbin containing portion 84 when the opening 24 is closed off by the cover portion 71. As also described above, the center axis Y of the cutting needle 91 is in a position where it passes through the through-hole 75 and the holding portion 74. Therefore, when cut work is performed, the waste fiber that the cutting needle 91 generates by cutting the work cloth enters the holding portion 74 from the through-hole 75 and is held there. Because the opening at the lower edge of the circumferential wall portion 72 is closed off by the bottom wall portion 73, the holding portion 74 is able to store the waste fiber in its interior. Therefore, when the sewing machine 1 performs cut work, the waste fiber is not scattered outside of the holding portion 74, that is, in the interior of the shuttle mechanism 80, including the interior of the bobbin containing portion 84, or inside the bed 2.

As was also explained above, the light path L, along which the light-emitting portion 96 of the lower thread sensor 95 that is provided inside the bed 2 emits light, passes through the interior of the bobbin containing portion 84. In a case where the holding portion 74 of the waste container 70 is disposed inside the bobbin containing portion 84, the light path L passes through the interior of the holding portion 74. The circumferential wall portion 72 and the bottom wall portion 73 of the holding portion 74 are transparent, so light passes through them. Therefore, by utilizing the function of the lower thread sensor 95, the CPU 61 of the sewing machine 1 (refer to FIG. 10) is able to detect the waste fiber that has accumulated inside the holding portion 74.

Figure 10:
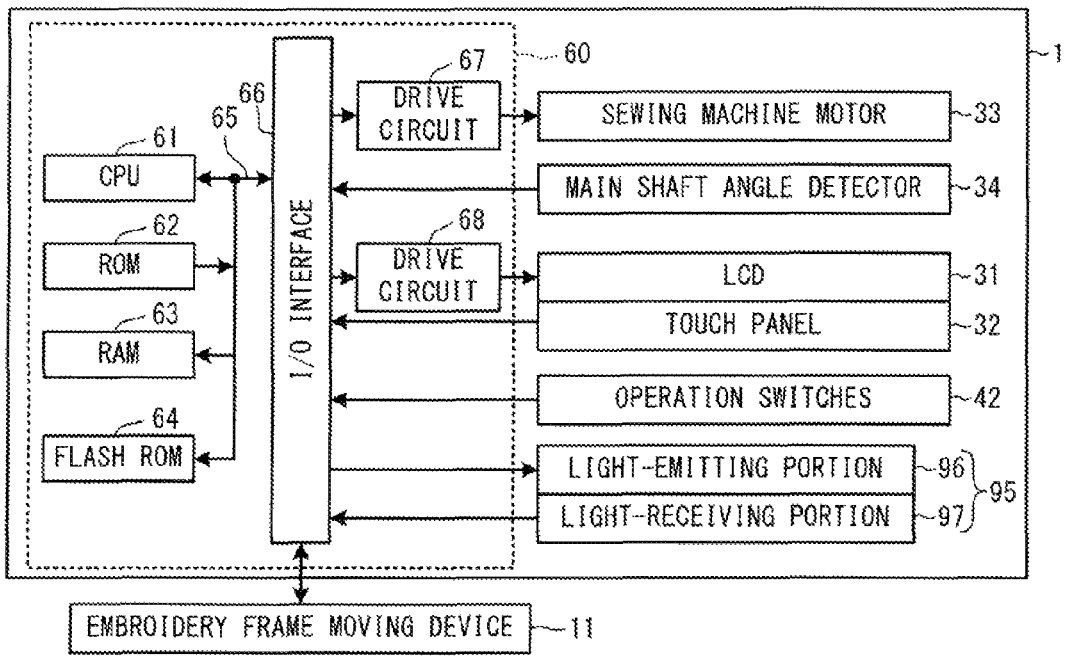
FIG. 10 is a block diagram that shows an electrical configuration of the sewing machine 1.

The electrical configuration of the sewing machine 1 will be explained with reference to FIG. 10. The sewing machine 1 is provided with the CPU 61 and with a ROM 62, a RAM 63, a flash ROM 64, and an input/output (I/O) interface 66, each of which is connected to the CPU 61 by a bus 65. The CPU 61 performs main control of the sewing machine 1 and, in accordance with various types of programs that are stored in the ROM 62, performs various types of computations and processing that are related to sewing and cut work. The ROM 62 is provided with a plurality of storage areas, including a program storage area and a pattern storage area, although these are not shown in the drawings. Various types of programs for operating the sewing machine 1 are stored in the program storage area. Among the stored programs, for example, is a program for waste fiber detection processing that is performed in a cut work mode that will be described later. Sewing data for sewing various types of patterns are stored in the pattern storage area. Cut data that describe a pattern in which the work cloth will be cut in the cut work mode are also stored in the pattern storage area, for example.

The cut data include data on the amounts by which the embroidery frame moving device 11 moves the embroidery frame (not shown in the drawings) on the bed 2. When cut work is performed, the CPU 61 causes the embroidery frame moving device 11 to move the embroidery frame in accordance with the cut data and moves the cutting needle 91 up and down by moving the needle bar 51 up and down, such that the work cloth is cut along the pattern.

Storage areas that store computation results and the like from computational processing by the CPU 61 are provided as necessary in the RAM 63. Various types of parameters for the performing of various types of processing by the sewing machine 1 are stored in the flash ROM 64. Drive circuits 67, 68, the main shaft angle detector 34, the touch panel 32, the operation switches 42, the light-emitting portion 96 and the light-receiving portion 97 of the lower thread sensor 95, and the embroidery frame moving device 11 are connected to the I/O interface 66.

The sewing machine motor 33 is connected to the drive circuit 67. The drive circuit 67 drives the sewing machine motor 33 in accordance with a control signal from the CPU 61. The driving of the sewing machine motor 33 rotates the main shaft, such that the needle bar up-and-down moving mechanism is driven and the needle bar 51 is moved up and down. The lower shaft is rotated by the rotating of the main shaft, and the outer shuttle 81 of the shuttle mechanism 80 is rotated by the rotating of the lower shaft. The main shaft and the outer shuttle 81 thus rotate in a synchronized manner. The lower thread sensor 95 is configured such that, in a case where the rotational angle of the main shaft (hereinafter called the main shaft angle) is not less than 5 degrees and not greater than 75 degrees (5 degrees to 75 degrees), the light that the light-emitting portion 96 of the lower thread sensor 95 emits is able to pass through the oblong hole 85 and the notch of the outer shuttle 81 and arrive at the light-receiving portion 97.

The drive circuit 68 drives the LCD 31 in accordance with a control signal from the CPU 61, causing the LCD 31 to display an image. The touch panel 32 that is provided on the front face of the LCD 31 outputs to the CPU 61 coordinate data that describe the position where an operation has been input using a finger, a special touch pen, or the like. Based on the coordinate data it has acquired from the touch panel 32, the CPU 61 recognizes the item that has been selected in the image that is displayed on the LCD 31 and performs the corresponding processing. In a case where the touch panel 32 has accepted the input of a specified operation that commands the sewing machine 1 to perform cut work, the CPU 61 (refer to FIG. 10) performs the waste fiber detection processing, which will be described later. The operation switches 42 accept operational inputs to the sewing machine 1, such as starting sewing, stopping sewing, and the like, separately from the touch panel 32 and output those inputs to the CPU 61.

The light-receiving portion 97, having received the light that was emitted from the light-emitting portion 96 of the lower thread sensor 95, generates an electric current that corresponds to the intensity of the received light, passes the current through the current-to-voltage conversion circuit (not shown in the drawings), and outputs the resulting voltage to the CPU 61. The CPU 61 uses a built-in A/D conversion portion to perform an A/D conversion of the magnitude of the voltage that corresponds to the intensity of the light that was input from the light-receiving portion 97, yielding an intensity value for the light that is expressed by a numerical value from 0 to 255, for example. The embroidery frame moving device 11 moves the embroidery frame in accordance with instructions that the CPU 61 outputs based on the cut data.

The waste fiber detection processing that the CPU 61 performs in the cut work mode will be explained with reference to FIGS. 11 and 12. The waste fiber detection processing is started in a case where a command to shift the operation mode of the sewing machine 1 to the cut work mode has been input on the touch panel 32, for example. The cut work mode is an operation mode in which, instead of the sewing needle that is mounted on the needle bar 51 for ordinary sewing, the cutting needle unit 90 is mounted on the needle bar 51, and cutting is performed on the work cloth that is held in the embroidery frame. The program that controls the operation of the sewing machine 1 in the cut work mode is stored in the ROM 62 (refer to FIG. 10) and is read into the RAM 63 and executed by the CPU 61. The program for the waste fiber detection processing is also read into the RAM 63 from the ROM 62 by the CPU 61 and executed in parallel with other programs.

Figure 11:
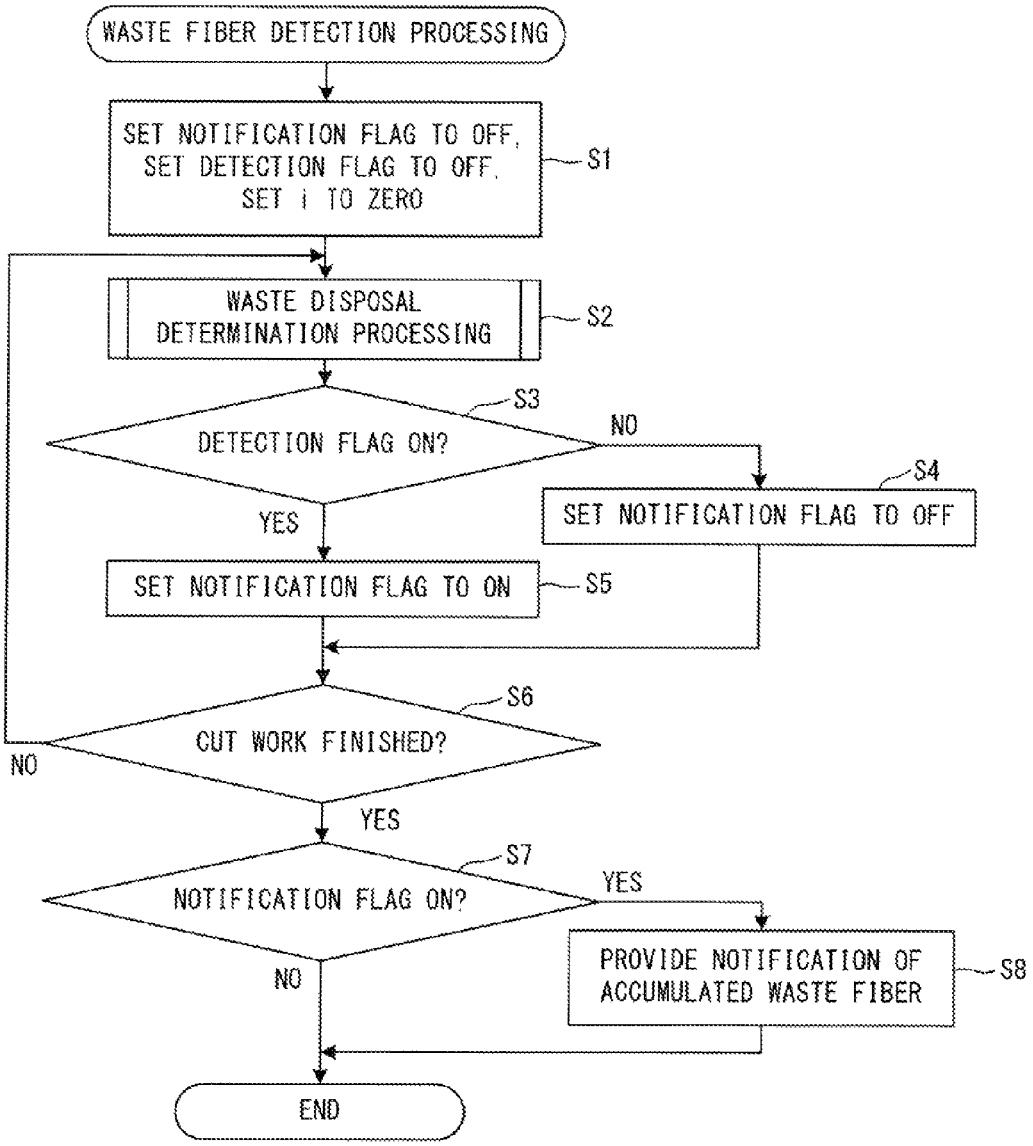
FIG. 11 is a flowchart of waste fiber detection processing that is performed in a cut work mode.

As shown in FIG. 11, the CPU 61 establishes storage areas in the RAM 63 for a notification flag and a detection flag, then sets both of the flags to OFF (Step S1). The CPU 61 also establishes a storage area for a counter i in the RAM 63 and sets the counter i to zero. The notification flag is a flag that is used for determining whether to issue a message (hereinafter called the disposal message) that urges the disposal of waste fiber that has accumulated inside the holding portion 74. In the present embodiment, the disposal message is a message that provides notification using an image that is displayed on the LCD 31. The detection flag is a flag for determining whether a specified amount of the waste fiber has accumulated inside the holding portion 74. The counter i is a counter for tallying the number of times that a determination has been made that the waste fiber has detected.

The CPU 61 performs a waste disposal determination processing subroutine (Step S2). As shown in FIG. 12, in the waste disposal determination processing, the CPU 61 determines, based on the output value from the main shaft angle detector 34, whether the main shaft angle is between 5 degrees and 75 degrees (Step S11). In a case where the main shaft angle is not between 5 degrees and 75 degrees (NO at Step S11), the waste fiber cannot be detected, because the light that the light-emitting portion 96 of the lower thread sensor 95 emits is obstructed by the outer shuttle 81 and cannot pass through the interior of the holding portion 74, so the CPU 61 returns the processing to Step S11. In a case where the main shaft angle is between 5 degrees and 75 degrees (YES at Step S11), the CPU 61 acquires the intensity value that corresponds to the intensity of the light that the light-receiving portion 97 of the lower thread sensor 95 has received (Step S12).

The CPU 61 determines whether the intensity value is less than a first judgment value (Step S13). As the amount of the waste fiber that has accumulated inside the holding portion 74 increases, it becomes harder for the light that has been emitted from the light-emitting portion 96 to pass through the interior of the holding portion 74, so the intensity value that the CPU 61 acquires for the light decreases. In the present embodiment, the CPU 61 determines whether to issue the disposal message by judging the intensity value of the light based on the first judgment value and a second judgment value, which are two threshold values. The first judgment value is a value that indicates that the amount of the waste fiber inside the holding portion 74 has reached an amount at which it is desirable to remove the waste fiber from the holding portion 74, and it is the threshold value that is used for determining whether to issue the disposal message. The second judgment value is greater than the first judgment value. The second judgment value is a threshold value for a case in which the determination as to whether to issue the disposal message is deferred, because although the amount of the waste fiber that has accumulated inside the holding portion 74 has increased, the holding portion 74 is still able to store more of the waste fiber. In a case where the waste fiber has not accumulated inside the holding portion 74, the intensity value is greater than the second judgment value (NO at Step S13; YES at Step S14). The CPU 61 resets the counter i to zero (Step S15) and sets the detection flag to OFF (Step S18), then advances the processing to Step S3 of the waste fiber detection processing.

As shown in FIG. 11, the CPU 61 determines whether the detection flag is ON (Step S3). In a case where the waste fiber has not accumulated inside the holding portion 74, the detection flag has been set to OFF (NO at Step S3), so the CPU 61 sets the notification flag to OFF (Step S4) and advances the processing to Step S6. The CPU 61 determines whether the cut work has been finished (Step S6). In a case where the cut work that is performed based on the cut data has not been finished (NO at Step S6), the CPU 61 returns the processing to Step S2 and repeats the processing at Steps S2 to S6.

Figure 12:
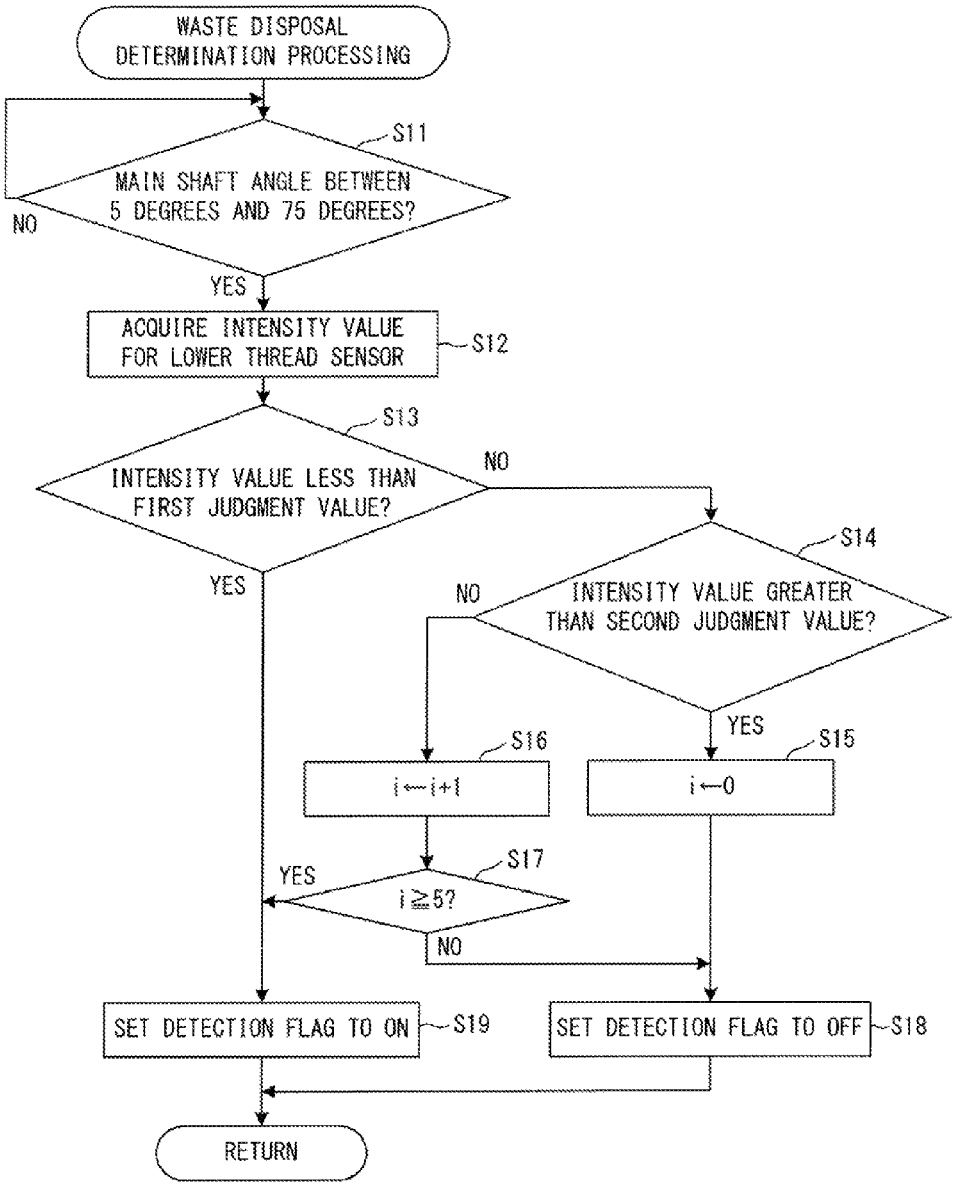
FIG. 12 is a flowchart of waste disposal determination processing.

In the waste disposal determination processing that is shown in FIG. 12, in a case where the waste fiber that accumulates inside the holding portion 74 increases in conjunction with the performing of the cut work and the intensity value becomes a value that is not less than the first judgment value and not greater than the second judgment value (NO at Step S13; NO at Step S14), the CPU 61 adds 1 to the counter i (Step S16). In the process of the accumulating of the waste fiber inside the holding portion 74, if the waste fiber accumulates in only one part of the holding portion 74, for example, the intensity value may temporarily become not greater than the second judgment value. In the present embodiment, while the Steps S2 to S6 of the waste fiber detection processing (refer to FIG. 11) are being repeated, in a case where the determination that the intensity value has become a value that is not less than the first judgment value and not greater than the second judgment value is made five times in succession, for example, the CPU 61 determines that the specified amount of the waste fiber has accumulated inside the holding portion 74. The CPU 61 determines whether the counter i is not less than 5. In a case where the counter i is less than 5 (NO at Step S17), the CPU 61 advances the processing to Step S18, keeps the detection flag OFF (Step S18), and advances the processing to Step S3 of the waste fiber detection processing. As described previously, after the intensity value has become not greater than the second judgment value, if the intensity value becomes greater than the second judgment value (YES at Step S14) before the counter i becomes not less than 5, the CPU 61 resets the counter i (Step S15). It is therefore possible to prevent the amount of the waste fiber that has accumulated inside the holding portion 74 from being detected incorrectly.

In a case where the waste fiber that accumulates inside the holding portion 74 has increased further and the intensity value has become less than the first judgment value (YES at Step S13), as well as in a case where the counter i has become not less than 5 (YES at Step S17), the CPU 61 sets the detection flag to ON (Step S19) and advances the processing to Step S3 of the waste fiber detection processing. As shown in FIG. 11, in a case where the detection flag is ON (YES at Step S3), the CPU 61 sets the notification flag to ON (Step S5) and advances the processing to Step S6. The CPU 61 repeats the processing at Steps S2 to S6, in the same manner as described above, until the cut work is finished.

In a case where the cut work that is performed based on the cut data has been finished (YES at Step S6), the CPU 61 determines whether the notification flag is ON (Step S7). In a case where the notification flag is OFF when the cut work is finished (NO at Step S7), the CPU 61 terminates the waste fiber detection processing. On the other hand, in a case where the notification flag is ON (YES at Step S7), the CPU 61 provides notification that the specified amount of the waste fiber has accumulated inside the holding portion 74 (Step S8). That is, the CPU 61 causes the LCD 31 to display the disposal message. After the disposal message is displayed, the CPU 61 terminates the waste fiber detection processing.

As explained above, in the sewing machine 1 of the present embodiment, the holding portion 74 of the waste container 70 can be disposed inside the bobbin containing portion 84 that is formed in the inner shuttle 82 of the shuttle mechanism 80. It is therefore not necessary for the sewing machine 1 to ensure additional space for mounting the waste container 70 inside the bed 2. Accordingly, the waste container 70 can easily be mounted in the sewing machine 1 without making any sort of changes to the configuration of the known sewing machine.

Furthermore, in a case where the sewing machine 1 is already provided with a function that optically detects the lower thread that is wound around the bobbin, that is, is already provided with the lower thread sensor 95, that function can be utilized for detecting the waste fiber that has accumulated inside the waste container 70. In other words, in a case where the waste container 70 is mounted and cut work is performed in the sewing machine 1 that is provided with the lower thread sensor 95, the waste fiber that has accumulated inside the waste container 70 can easily be detected by the lower thread sensor 95 without removing the waste container 70 from the needle plate 20. The configuration of the known sewing machine can therefore be utilized in its existing form, making it possible to provide the sewing machine 1 at low cost.

When the waste container 70 is mounted in the bed 2, the outer side 71A of the cover portion 71 forms a flat surface that is substantially in the same plane as the top face 20A of the needle plate 20 in the bed 2. Furthermore, in a case where the cover portion 71 has a structure through which light can pass, that is, where the cover portion 71 is transparent, the waste fiber that has accumulated inside the waste container 70 can easily be visually recognized through the cover portion 71 without removing the waste container 70 from the bed 2.

Configuring the bottom wall portion 73 such that it can be opened and closed in relation to the circumferential wall portion 72 makes it possible for the waste fiber that has accumulated inside the waste container 70 to be removed easily. Because the bottom wall portion 73 does not separate from the circumferential wall portion 72, there is no concern that bottom wall portion 73 might be lost.

Moreover, the opening-and-closing lever 28 that is provided in the second needle plate 22 of the needle plate 20 is configured such that it can engage with the hook 76 of the cover portion 71, so when the waste container 70 is mounted, the cover portion 71 does not disengage from the needle plate 20. Therefore, the outer side 71A and the top face 20A of the needle plate 20 are able to maintain a flat surface in the same plane. Accordingly, when the work cloth is being moved together with the embroidery frame, the work cloth does not get caught on the cover portion 71.

Furthermore, the lower thread sensor 95 is configured to optically detect the waste fiber inside the waste container 70, so there is no need to provide a separate, dedicated detector in order to detect the waste fiber. Therefore, the sewing machine 1 can be provided at low cost.

In addition, having the sewing machine 1 issue the disposal message to urge the disposal of the waste fiber from the waste container 70 makes it possible to prevent the waste fiber inside the waste container 70 from overflowing and leaking out of the waste container 70.

It is also possible for the waste fiber that is generated when the work cloth is cut by the cutting needle unit 90 to be stored inside the waste container 70 through the through-hole 75. The waste fiber is therefore not scattered inside the bed 2 and does not impede the rotation of the shuttle mechanism 80. It is also easy to dispose of the waste fiber.

Various types of modifications can be made to the embodiment that is described above. The waste container 70 is mounted on the needle plate 20 by attaching the cover portion 71 to the opening 24 in the second needle plate 22. However, it is not absolutely necessary for the waste container 70 to be mounted on the needle plate 20. For example, in a case where the opening 24 is formed in the top face 2A of the bed 2, instead of in the needle plate 20, the waste container 70 may be mounted on the bed 2. Moreover, in a case where the opening 24 is formed in a separate member that covers the top of the shuttle mechanism 80 and is provided in the top face 2A of the bed 2 as a different member from the needle plate 20, the waste container 70 may also be mounted on the separate member.

The disposal message does not have to be a message that is displayed on the LCD 31. For example, the CPU 61 may also issue the disposal message by outputting an audio message to a speaker that is provided in the sewing machine 1, although this is not shown in the drawings. The CPU 61 may also issue the disposal message by causing an LED lamp that is provided in the sewing machine 1 to turn on or flash. Furthermore, the determination that the disposal message will be issued is made by the CPU 61, but it may also be made by an electrical circuit such as an ASIC or the like, based on the intensity of the light that is received by the light-receiving portion 97, and the electrical circuit may also output a command signal to issue the disposal message.

In the waste container 70, the holding portion 74 is formed from a material through which light passes, but the material through which light passes may be either one of a transparent material and a semi-transparent material. A portion of the holding portion 74 may also be formed from a material through which light does not pass, due to a change in the position of the lower thread sensor 95. For example, if the light path L is configured to pass only through the circumferential wall portion 72, it is sufficient for at least the circumferential wall portion 72 to be formed from a material through which light passes, and it is acceptable for the cover portion 71 not to be formed from a material through which light passes.

The cover portion 71 is attached to the opening 24 by the pressing of the support plate 27 of the needle plate 20 on the projecting portion 77 and the engaging of the hook 76 with the opening-and-closing lever 28. However, the cover portion 71 may also be attached by being fitted into the opening 24, for example. The hook 76 is provided on the underside 71B of the cover portion 71, but it may also be provided on a side face of the cover portion 71.

The circumferential wall portion 72 of the holding portion 74 that is provided on the underside 71B of the cover portion 71 is formed as a single unit with the cover portion 71. However, the circumferential wall portion 72 may also be formed as a separate piece from the cover portion 71 and may be affixed to the cover portion 71 by being glued, by being fitted into the cover portion 71, by the tightening of a screw, or the like. Furthermore, the bottom wall portion 73 pivots, with the circumferential wall portion 72 as a fulcrum point, but the bottom wall portion 73 may also be attached to the circumferential wall portion 72 by being fitted into the circumferential wall portion 72, by the tightening of a screw, or the like.

Figure 13:
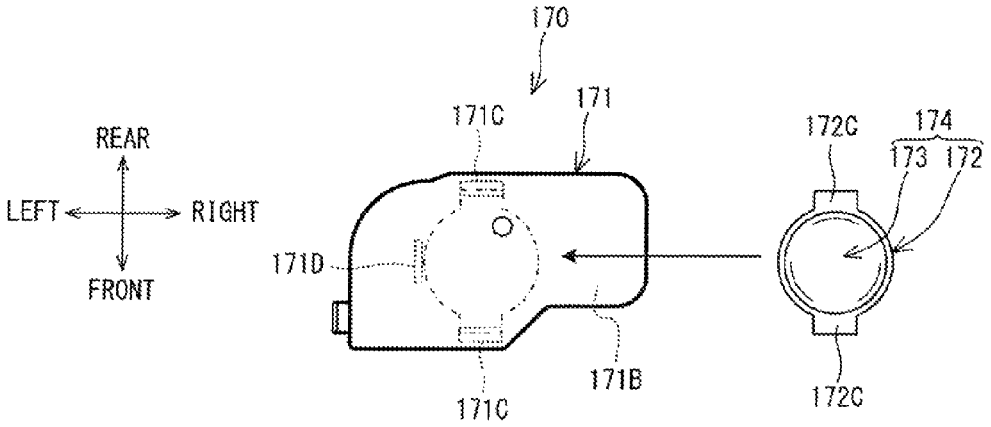
FIG. 13 is a plan view of a waste container 170 in a state in which a holding portion 174 has been removed from a cover portion 171.

The holding portion 74 may also be attached to the cover portion 71 by being fitted into the cover portion 71, by the tightening of a screw, or the like. For example, a waste container 170 that is shown in FIG. 13 is provided with a pair of hooks 171C and a stopper 171D on an underside 171B of a cover portion 171. A holding portion 174 is a circular container shape that is provided with a ring-shaped circumferential wall portion 172 and a bottom wall portion 173 that closes off an opening at the lower edge of the circumferential wall portion 172. On its upper edge, the holding portion 174 is provided with a pair of protruding portions 172C that protrude radially outward. When the holding portion 174 is assembled onto the cover portion 171, the upper edge of the holding portion 174 is brought into contact with the underside 171B of the cover portion 171, and the holding portion 174 is slid leftward in relation to the cover portion 171. The pair of the protruding portions 172C are engaged with the pair of the hooks 171C, and the holding portion 174 is disposed in relation to the cover portion 171 in a position where the left edge of the circumferential wall portion 172 comes into contact with the stopper 171D. The waste container 170 with this sort of form is also mounted on the needle plate 20 by attaching the cover portion 171 to the needle plate 20 and closing off the opening 24, thus making it possible to dispose the holding portion 174 inside the bobbin containing portion 84 such that the waste fiber from the work cloth that is generated when cut work is performed is stored in the holding portion 174. Furthermore, with the waste container 170, the waste fiber that has accumulated inside the waste container 170 can easily be removed by removing the holding portion 174 from the cover portion 171.

What is claimed is:

1. A container that is configured to be removably mounted on a needle plate of a sewing machine that is provided with a horizontal shuttle inside a bed in which the needle plate is provided, the horizontal shuttle being provided with an outer shuttle and an inner shuttle that is disposed inside the outer shuttle, with the inner shuttle including a bobbin containing portion that accommodates a bobbin, the container comprising:

a cover body that is plate-shaped and is configured to be removably mounted in the needle plate in a position above the horizontal shuttle, the cover body including a first face and a through-hole that extends through the cover body, the first face being configured to occupy the same plane as a top face of the needle plate when the cover body is mounted in the needle plate; and a holding body that is configured to be disposed inside the bobbin containing portion and that includes a side wall and a bottom wall, the side wall encircling an area of a second face in which the through-hole is formed, the second face being a face on the opposite side of the cover body from the first face, and the bottom wall being disposed such that the bottom wall is opposite the second face.

2. The container according to claim 1, wherein the holding body is formed from a light-permeable material.

3. The container according to claim 1, wherein the cover body is formed from a light-permeable material.

4. The container according to claim 1, wherein the bottom wall is configured to open and close in relation to the side wall.

5. The container according to claim 4, wherein
one edge of the bottom wall pivots on the side wall.

6. The container according to claim 1, wherein
the holding body is configured to be removably mounted on the cover body.

7. The container according to claim 1, wherein
the cover body is provided with a mounting-and-removing device for mounting the cover body in the needle plate and removing the cover body from the needle plate.

8. A sewing machine, comprising:
a horizontal shuttle that is provided with an outer shuttle and an inner shuttle, and that is in a bed, the inner shuttle being disposed inside the outer shuttle and including a bobbin containing portion that accommodates a bobbin;
a needle plate that is provided in a top portion of the bed;
a container that is configured to be removably mounted on the needle plate and that is provided with a cover body and a holding body,
the cover body being plate-shaped, configured to be removably mounted in the needle plate in a position above the horizontal shuttle, and including a first face and a through-hole that extends through the cover body, the first face being configured to occupy the same plane as a top face of the needle plate when the cover body is mounted in the needle plate,
the holding body being configured to be disposed inside the bobbin containing portion and including a side wall and a bottom wall,
the side wall encircling an area of a second face in which the through-hole is formed, the second face being a face on the opposite side of the cover body from the first face, and
the bottom wall being disposed such that the bottom wall is opposite the second face.

9. The sewing machine according to claim 8, further comprising:
a detector that, in a case where the container has been mounted on the needle plate, is configured to detect waste fiber accumulated inside the holding body that is disposed in the bobbin containing portion, the detector being provided inside the bed and that is configured to detect a lower thread that is wound around the bobbin when the bobbin is contained in the bobbin containing portion; and
a control device that determines whether a specified amount of waste fiber has accumulated inside the holding body, based on a detection result from the detector.

10. The sewing machine according to claim 9, wherein
the holding body is formed from a light-permeable material, and
the detector is provided with a light-emitting device and a light-receiving device,
the light-emitting device being provided to the side of the inner shuttle and emitting light toward the bobbin containing portion, and
the light-receiving device being provided in such a position that the inner shuttle is between the light-emitting device and the light-receiving device and receiving the light that the light-emitting device has emitted and that has passed through the holding body that is provided in the bobbin containing portion.

11. The sewing machine according to claim 10, further comprising:
a notifying device that provides notification of information,
wherein
the control device, in a case where an intensity value that indicates the intensity of the light that the light-receiving device has received is less than a specified threshold value, determines that the specified amount of the waste fiber has accumulated inside the holding body and causes the notifying device to provide notification of information that requests disposal of the waste fiber.

12. The sewing machine according to claim 8, wherein
the cover body is formed from a light-permeable material.

13. The sewing machine according to claim 8, wherein
the bottom wall is configured to open and close in relation to the side wall.

14. The sewing machine according to claim 13, wherein
one edge of the bottom wall pivots on the side wall.

15. The sewing machine according to claim 8, wherein
the holding body is configured to be removably mounted on the cover body.

16. The sewing machine according to claim 8, wherein
the cover body is provided with a mounting-and-removing device for mounting the cover body in the needle plate and removing the cover body from the needle plate.

17. The sewing machine according to claim 8, further comprising:
a needle bar; and
a cutting needle unit that is configured to be removably mounted on the needle bar and that is provided with a body and a mounting portion,
the body supporting a cutting needle that has a cutting edge, and
the mounting portion attaching the body to the needle bar in a position where the cutting edge is able to pass through the through-hole in the container that is mounted on the needle plate.

* * * * *